US009204732B2

(12) United States Patent
Wyatt et al.

(10) Patent No.: US 9,204,732 B2
(45) Date of Patent: Dec. 8, 2015

(54) THERAPEUTIC MATTRESS ASSEMBLY

(71) Applicant: Tempur-Pedic Management, LLC, Lexington, KY (US)

(72) Inventors: Charles C. Wyatt, Laguna Hills, CA (US); Ricky J. Fontaine, Lexington, KY (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

(21) Appl. No.: 14/318,609

(22) Filed: Jun. 28, 2014

(65) Prior Publication Data

US 2014/0310880 A1 Oct. 23, 2014

Related U.S. Application Data

(62) Division of application No. 10/415,629, filed as application No. PCT/US01/44111 on Nov. 6, 2001, now Pat. No. 8,789,224.

(60) Provisional application No. 60/246,356, filed on Nov. 7, 2000.

(51) Int. Cl.

| | |
|---|---|
| ***A47C 27/10*** | (2006.01) |
| ***A47C 27/08*** | (2006.01) |
| ***A61G 7/05*** | (2006.01) |
| *A61G 7/057* | (2006.01) |
| *A61G 7/075* | (2006.01) |
| *A61G 7/008* | (2006.01) |
| *A61G 7/10* | (2006.01) |

(52) U.S. Cl.

CPC ..... *A47C 27/088* (2013.01); *A47C 27/10* (2013.01); *A61G 7/0525* (2013.01); *A61G 7/05776* (2013.01); *A61G 7/008* (2013.01); *A61G 7/05715* (2013.01); *A61G 7/0755* (2013.01); *A61G 7/1021* (2013.01); *A61G 2007/05784* (2013.01); *A61G 2200/32* (2013.01); *A61G 2200/56* (2013.01); *Y10T 29/481* (2015.01)

(58) Field of Classification Search

CPC ..... A47C 27/10
USPC ..... 5/710, 713, 715, 644, 648
See application file for complete search history.

(56) References Cited

U.S. PATENT DOCUMENTS

| | | | | |
|---|---|---|---|---|
| 6,370,716 | B1 * | 4/2002 | Wilkinson | 5/715 |
| 6,839,929 | B2 * | 1/2005 | Stolpmann | 5/710 |

* cited by examiner

*Primary Examiner* — Fredrick Conley
(74) *Attorney, Agent, or Firm* — J. Mark Wilkinson

(57) ABSTRACT

A therapeutic mattress assembly comprising a mattress having a substrate assembly that includes a plurality of cylinders positioned side by side over the length of the mattress. Each cylinder is configured as a low air loss system to allow air to flow into the cylinder from a source and out of the cylinder through small holes located on the top of each cylinder. An overlay assembly provides a foam cushion that provides a supporting surface above the substrate assembly for the patient. A calf lift bladder operates to effectively raise or lower the patient's feet to prevent pressure related injuries. A lateral rotation assembly selectively raises and lowers a selected half of the mattress to turn patients in a lateral direction. A bolster inflates in response to the lateral rotation assembly to secure the patient within the mattress.

10 Claims, 8 Drawing Sheets

14
134
18
138
146
10

20
174
176
194
190
196
SELECTOR VALVE
170
22
CONTROLLER
30

THERAPEUTIC MATTRESS ASSEMBLY

This application is a divisional of U.S. patent application Ser. No. 10/415,629, filed May 1, 2003 which is a national stage filing of Patent Cooperation Treaty Application Serial No. PCT/US2001/044111, filed Nov. 6, 2001 which claims priority to U.S. Provisional Patent Application Ser. No. 60/246,356 filed Jul. 11, 2000.

FIELD OF THE INVENTION

The invention relates generally to inflatable mattress systems, and particularly to a mattress assembly combining an inflatable substrate and a foam support surface.

BACKGROUND OF THE INVENTION

Inflatable mattresses are used in hospital rooms, old age homes, and other applications in which a person is required to spend long periods of time restricted to a bed. A common problem for patients requiring such long-term care is the development of decubitus ulcers, or bed sores, caused by excessive pressure applied to a patient's contact points. A patient's weight on a bed can cause a counter force to be applied to the patient's body from the bed at points where the patient's body contacts the bed. Although contact points can be present across the body, it is common for sick and disabled individuals who are bed bound to develop tissue damage on the heels of the feet, on the ankle, and/or on other parts of the body. This tissue damage to the heels is generally the result of an individual lying in a supine position where the heels bear the weight of the legs on the surface of the mattress. Alternatively, if the individual is in a sidelying position, the ankle will bear the weight of the legs against the mattress. Often, this pressure exceeds the ability of the capillaries to circulate blood to the cells which results in an isohemic condition. Lacking blood supply, these cells die causing the tissue damage.

In known continuous flow, low air loss mattresses, air is used to expand the mattress to a-desired pressure. Air is allowed to escape the air mattress through small holes located on the top of the mattress. These holes serve to maintain a constant mattress pressure against the patient and provide air flow between the patient and the mattress to remove, humidity created by the patient's body. This feature keeps the mattress dry, accelerates the healing process, and helps prevent bed sores. An example of one such air loss system is disclosed in U.S. Pat. No. 4,896,389 to Chamberland.

Leg elevation is a commonly employed method of removing pressure from heels in the supine position and from the ankles in a sidelying position. This is frequently accomplished by placing pillow or wedges under and/or between the legs of the individual on the mattress.

A mattress that includes multiple inflatable air chambers to assist in relieving pressure from contact points for bed bound patients is disclosed in U.S. Pat. No. 4,953,247 to Hasty. These inflatable mattresses have varied the pressure in specific chambers to help contour the mattress and apply equal force throughout the patient's body.

U.S. Pat. No. 5,666,681 to Meyer et al. discloses a device for relieving pressure on a patient's heels and/or ankles by employing multiple air chambers under the patient's heels that are located within the mattress. A first air chamber directly under the heels deflates allowing the heels to sink down into the mattress while the pressure of a second forwardly adjacent air chamber increases to lift the calves to further reduce the stress on the heels.

SUMMARY OF INVENTION

The present invention allows for distribution of pressure across a patient's body, adjustment calf elevation for the further reduction of stress on a patient's heels and ankles, rotation of a patient laterally on the mattress, and controlled inflation of alternating cylinders within the substrate assembly.

The present invention incorporates a continuous flow, low air loss mattress with an overlay made of visco-elastic foam and a calf lift bladder to provide the benefits associated with leg elevation while avoiding the problems associated with existing methods. This pneumatically powered calf elevator serves to reduce/relieve pressure against the heels and ankles by lifting them from the surface of the mattress.

In one embodiment, the invention provides a therapeutic mattress assembly with various features designed to relieve pressure for a patient. The therapeutic mattress itself consists of a bottom cover and a separable top cover that form an enclosure. Within the bottom cover and the top cover is a substrate assembly, a calf lift bladder, and an overlay assembly. The substrate assembly is made up of multiple cylinders, each having elongated chambers that extend laterally across the width of the mattress. The cylinders are aligned side by side, directly adjacent to each other, along the length of the mattress. Each cylinder is an individually sealed chamber in which the pressure can be varied. The upper surfaces of the air cylinders are perforated to provide the low air loss effect. The cylinders are expandable by air pressure to varying heights to disperse the pressure against the body of the patient. The cylinders also include multiple layers of foam positioned within each cylinder that act to support the patient when the cylinders are deflated.

The calf lift bladder is a single inflatable chamber located near the foot end of the mattress and extending across the width of the therapeutic mattress. The upper surface of the therapeutic mattress is flat when the calf lift bladder is deflated. When inflated, the calf lift bladder creates a bulge in the therapeutic mattress, raising the patient's calves relieving the pressure on the patient's heels and/or ankles. The calf lift bladder can be set to any position between the fully inflated and fully deflated positions to properly accommodate the patient. However, in other embodiments the calf lift bladder could be located between any of the components of a multi-component mattress or the bladder could lie on top of the mattress above the upper layer.

The position of the calf lift bladder can be adjusted along the length of the therapeutic mattress according to the height of the patient. The calf lift bladder is also preferably positioned between the overlay assembly and the plurality of cylinders. The positioning of the calf lift bladder is advantageous because it does not interfere with elements located within the substrate assembly. In addition, unlike the pillow method, the calf bladder does not introduce additional items to the surface of the bed which is generally undesirable. Further, the degree of calf elevation is easily adjusted by the air pressure directed to the calf lift bladder, whereas ordinary pillows have physical properties of density and thickness which may not be optimal for individual needs.

The lateral rotation assembly includes first and second lateral rotation wedges that extend the length of the mattress and that are located under the therapeutic mattress. Each lateral rotation wedge can be inflated to a wedge shape with the narrowest portion of the wedge in the center of the mattress. These lateral rotation wedges can be individually inflated to raise a respective side of the mattress. When the lateral rotation wedge on one side of the mattress is inflated the mattress is tilted creating a slant along one half of the width of the mattress. Each lateral rotation wedge can tilt its respective half of the mattress to an angle of approximately 30 degrees from the center of the mattress. When the mattress is tilted from one side to the other, the patient is also rotated to alternate pressure caused by the patient's weight. The overlay assembly has inflatable bolsters, or side rails, located along the sides of the overlay assembly to aid in securing the patient on the mattress while one side is being raised. Preferably, only the bolster positioned opposite the inflated lateral rotation bladder is inflated.

The overlay lies above the main air bladders and preferably includes a visco-elastic foam cushion. The overlay provides a smooth surface for the patient to rest on and distributes the pressure between the patient and the air cylinders. The visco-elastic foam material possesses specific thermally activated properties which the conform the surface to the shape of the patient's body. This feature also distributes the weight of the patient over a greater area.

The mattress also includes a blower assembly that includes a blower, a valve assembly, and a controller. The blower is the air source for and is in selective fluid flow connection with the air cylinders, the lateral rotation wedges, the bolsters, and the calf lift bladder. The valve assembly selectively distributes the air flow from the blower to either the air cylinders or the lateral rotation wedge and the bolsters. In addition, the valve assembly selectively distributes air to the calf bladder independent of the air cylinders, and the lateral rotation wedges and bolsters. The controller regulates the valve assembly and the blower provides and adjusts the air pressure supply. The controller contains a microprocessor and can be programmed to increase the air pressure in specific cylinders to alternate the pressure on the patient.

Another feature of the mattress is the low air loss system that allows air to reach surfaces of the patient's body that contact the mattress. The blower provides a constant air flow to the cylinders while the upper surface of the cylinders are perforated to permit the air to escape. Because of this constant flow, the cylinders can maintain a desired air pressure even though air is leaking through the upper surface of the cylinders. The overlay assembly is also permeable and allows the air to flow through and reach the patient.

Other features and advantages of the invention will become apparent to those skilled in the art upon review of the following detailed description, claims, and drawings.

Figure 1:
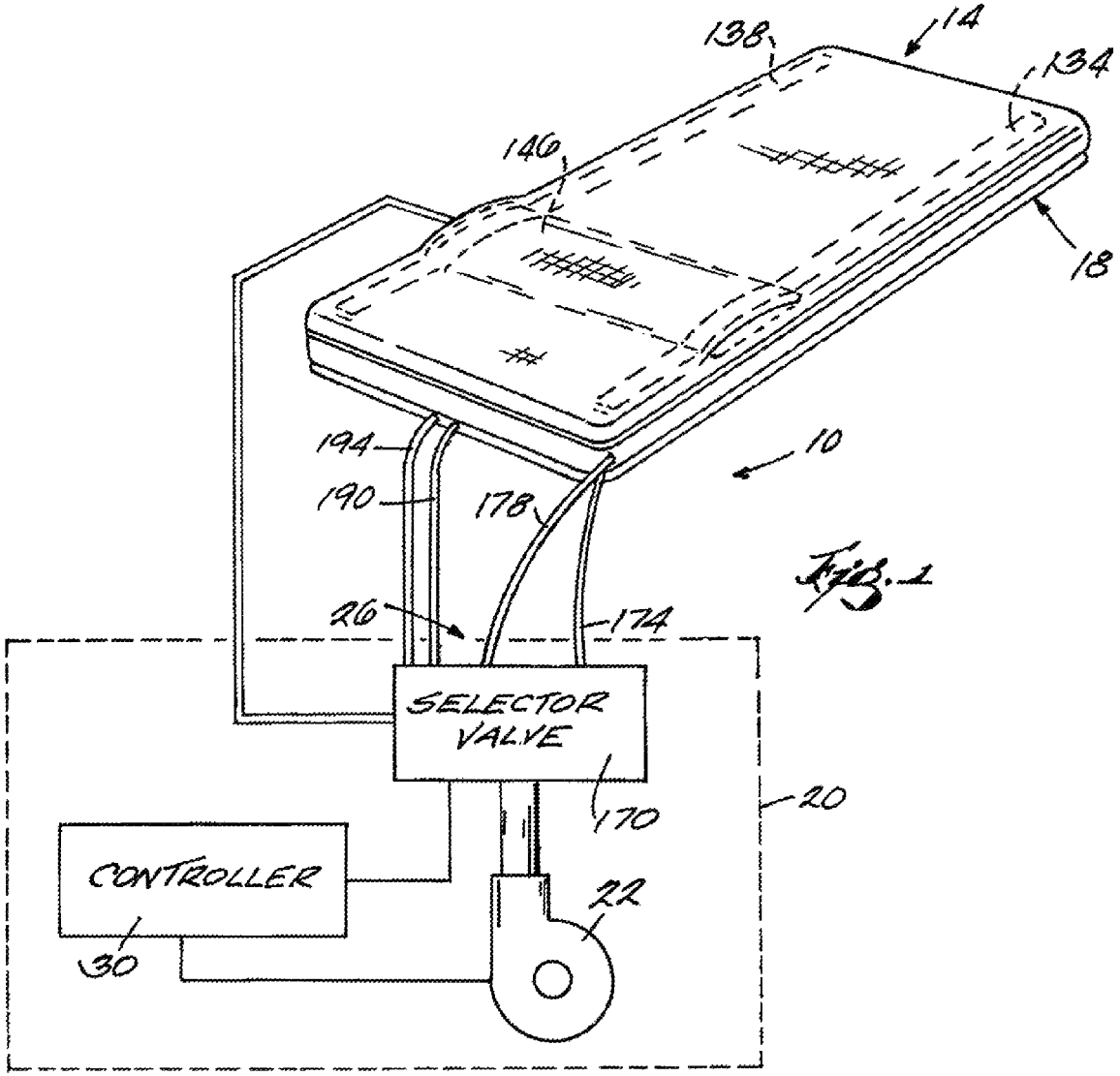
FIG. 1 is a schematic view illustrating a therapeutic mattress assembly embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIGS. 1-11 illustrate a therapeutic mattress assembly 10 embodying the invention. With reference to FIG. 1, the therapeutic mattress assembly 10 includes a mattress 14, and a lateral rotation assembly 18 located under the mattress 14 to assist in turning a patient on the mattress 14. The therapeutic mattress assembly 10 also includes a blower assembly 20 that includes a blower 22, a valve assembly 26 connected to the blower 22, and a controller 30 connected between the blower 22 and valve assembly 26 to regulate the air flow to the mattress 14 and the lateral rotation assembly 18.

Figure 2:
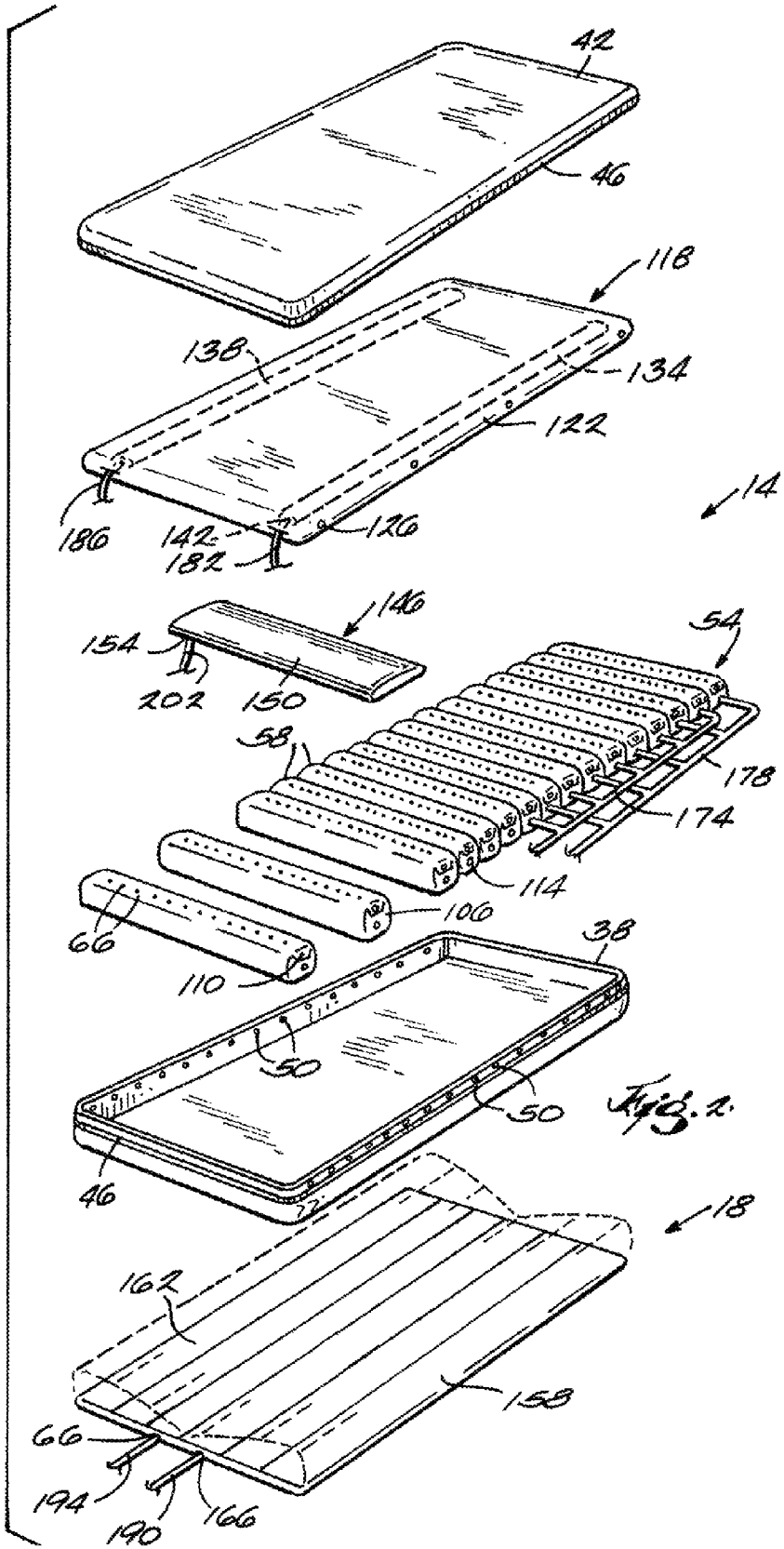
FIG. 2 is an exploded view illustrating the therapeutic mattress assembly shown in FIG. 1.
Figure 3:
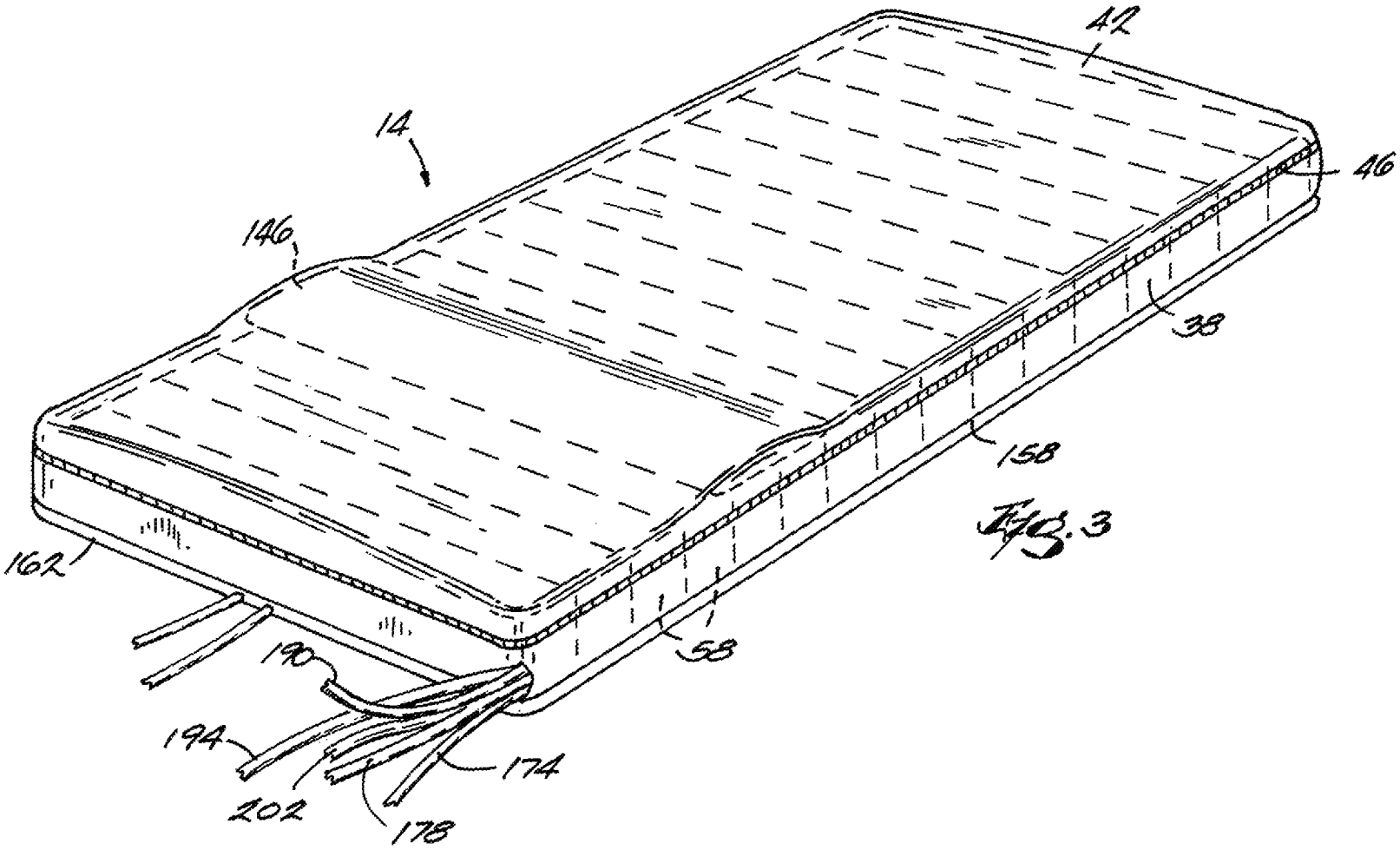
FIG. 3 is a perspective view illustrating a mattress of the therapeutic mattress assembly shown in FIG. 1.
Figure 4:
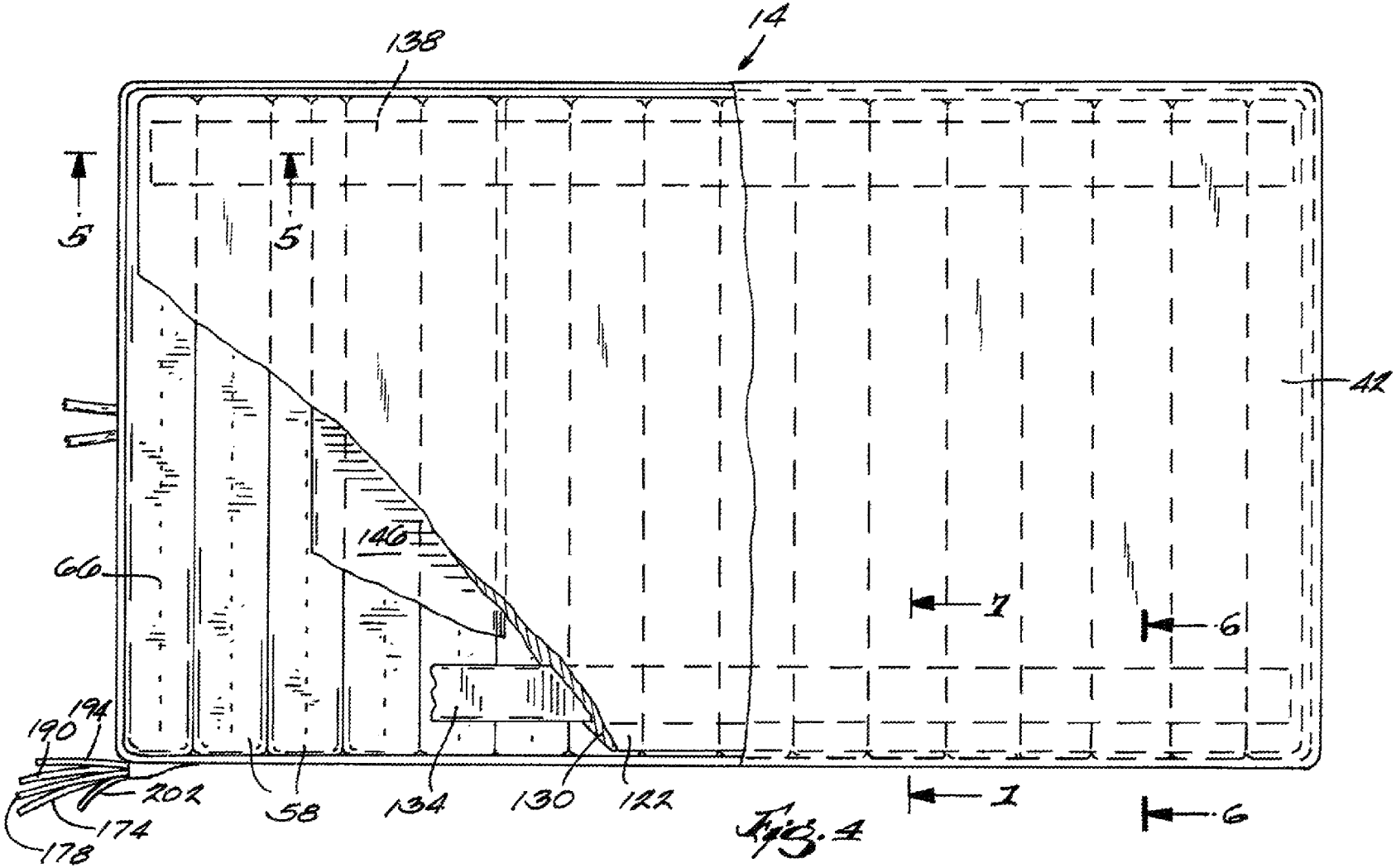
FIG. 4 is a top view illustrating the mattress shown in FIG. 3.

With reference to FIGS. 2-4, the mattress 14 includes a bottom cover 38 and a top cover 42 detachably connected to the bottom cover 38 to form an enclosure. In the preferred embodiment, the perimeter of the top cover 42 is detachably connected to the perimeter of the bottom cover 38 by a zipper 46. The bottom cover 38 defines an upwardly facing cavity with four interconnected side walls connected to a bottom wall. The bottom cover 38 includes a plurality of mating snaps 50 located on both the interior and the exterior of the side walls. The function of these mating snaps 50 will be discussed below. The top cover 42 is preferably made from a high moisture vapor transfer (MVT) material that specifically will allow the transfer of air but is moisture resistant.

The mattress 14 includes a substrate assembly 54 positioned within the enclosure formed by the top and bottom covers 42, 38. The substrate assembly 54 includes a plurality of elongated cylinders 58 extending the width of the bottom cover 38 and positioned side by side along the length of the bottom cover 38. As best shown in FIGS. 4-7, each cylinder 58 includes a sleeve 52 preferably made from an air impermeable material such as urethane coated nylon. The sleeve 52 is a completely enclosed casing that defines an interior cavity. The top surface of the sleeve 52 includes multiple pin-sized holes 66 preferably spaced about 3 inches apart across the length of the sleeve 52.

Figure 5:
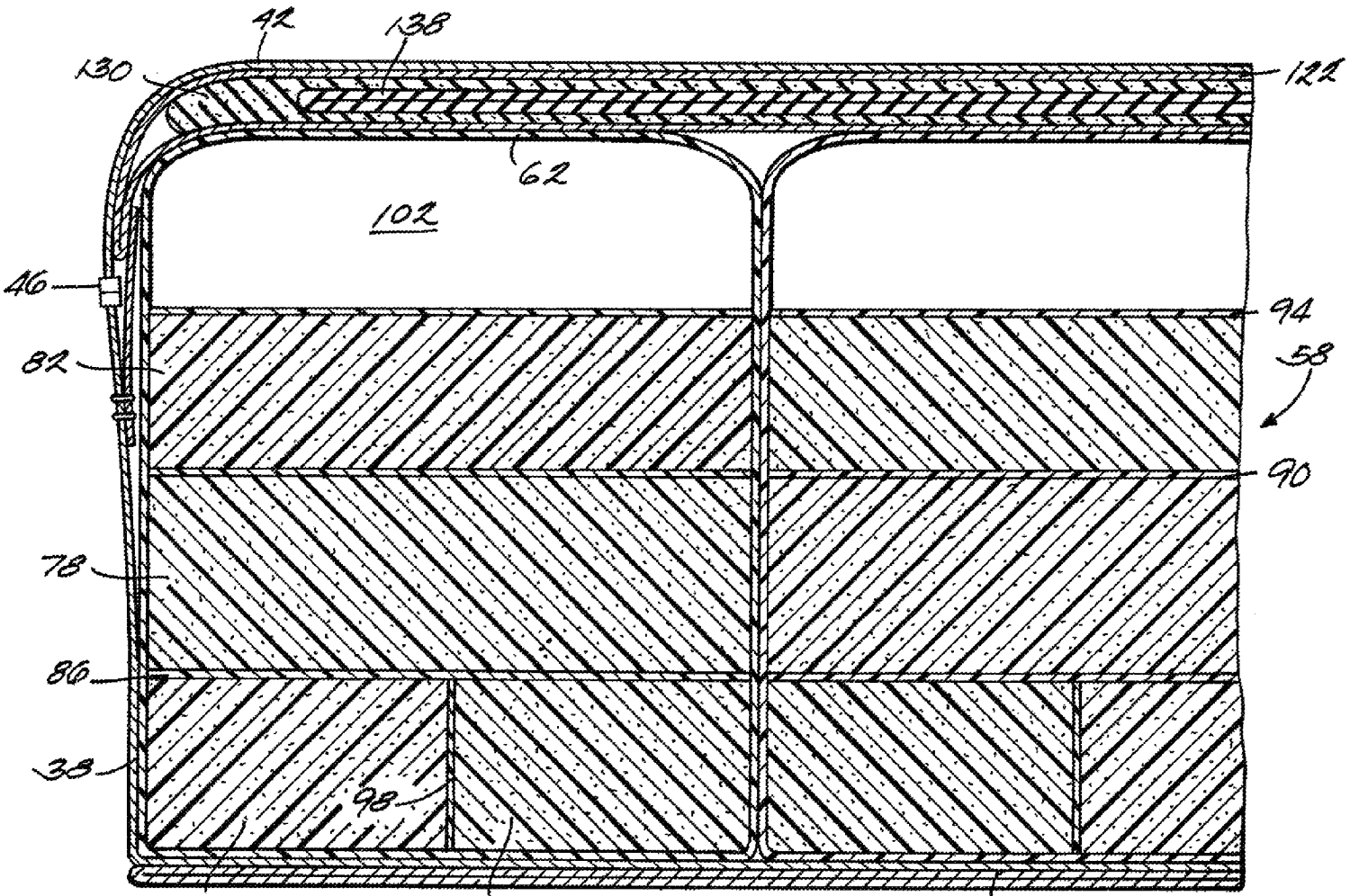
FIG. 5 is a cross-sectional view taken along line 5-5 in FIG. 4, illustrating a cylinder in the inflated condition.

As shown in FIG. 5, the cylinder 58 also includes a left base foam layer 70 and a right base foam layer 74 positioned adjacent to the left base foam layer 70, both positioned within the sleeve 52. The left and right base foam layers 70, 74 extend approximately the entire length of the sleeve 52 and each extend about one half of the width of the sleeve 52. Preferably, the left and right base foam layers 70, 74 are about 1¾ inches thick and made of reticulated foam. The cylinder 58 also includes an intermediate foam layer 78 positioned above the left and right base foam layers 70, 74. The intermediate foam layer 78 extends approximately the entire length and width of the sleeve 52. Preferably, the intermediate foam layer 78 is about 1 inch thick and is made of high resilience foam. The cylinder 58 also includes a top foam layer 82 positioned on top of the intermediate foam layer 78, extending approximately the entire length and width of the sleeve 52. Preferably, the top foam layer 82 is about 1½ inches thick and is made of visco-elastic foam.

The visco-elastic foam material possesses specific thermally activated properties which causes the foam surface to conform to the shape of the patient's body. Specifically, the visco-elastic foam has a lower compression coefficient at an elevated temperature as compared to the compression coefficient at a cooler temperature. The body heat of the patient acts to soften the visco-elastic foam directly supporting the body while the part of the cushion not supporting the body remains in a firmer condition. This feature also allows for a more equal distribution of the patient's weight over a greater surface area.

The sleeve 52 also includes a first, second, and third horizontal gusset 86, 90, 94, and a vertical gusset 98 positioned within the sleeve 52 to provide the cylinder 58 with a substantially rectangular shape when inflated. The first horizontal gusset 86 is located directly between the left and right base foam layers 70, 74 and the intermediate foam layer 78 and is connected between the interior side walls of the sleeve 52. The second horizontal gusset 90 is located directly between the intermediate foam layer 78 and the top foam layer 82 and is connected between the interior side walls of the sleeve 52. The third horizontal gusset 94 is located directly above the top foam layer 82 and is connected between the interior side walls of the sleeve 52. The third horizontal gusset 94 substantially defines an air cavity 102 between the third horizontal gusset 94 and the top interior wall of sleeve 52. The vertical gusset 98 is positioned between the left and right base foam layers 70, 74 and is connected between the first horizontal gusset 86 and the bottom interior wall of the sleeve 52. Preferably, the horizontal gussets 86, 90, 94 are substantially parallel to each other and the vertical gusset 98 is generally perpendicular to the horizontal gussets 86, 90, 94.

Figure 7:
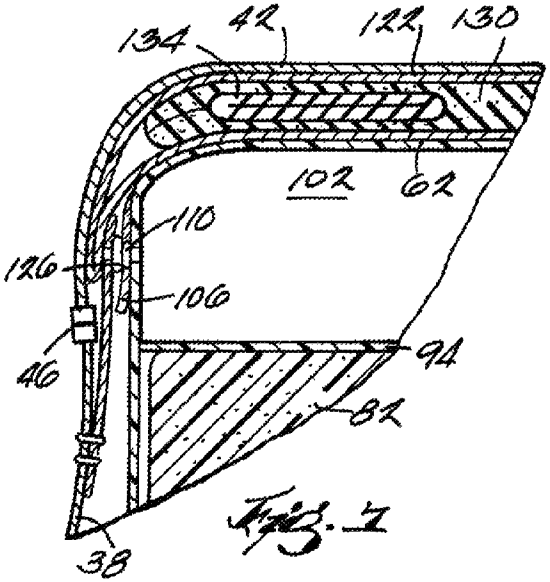
FIG. 7 is a cross-sectional view taken along line 7-7 in FIG. 4.
Figure 6:
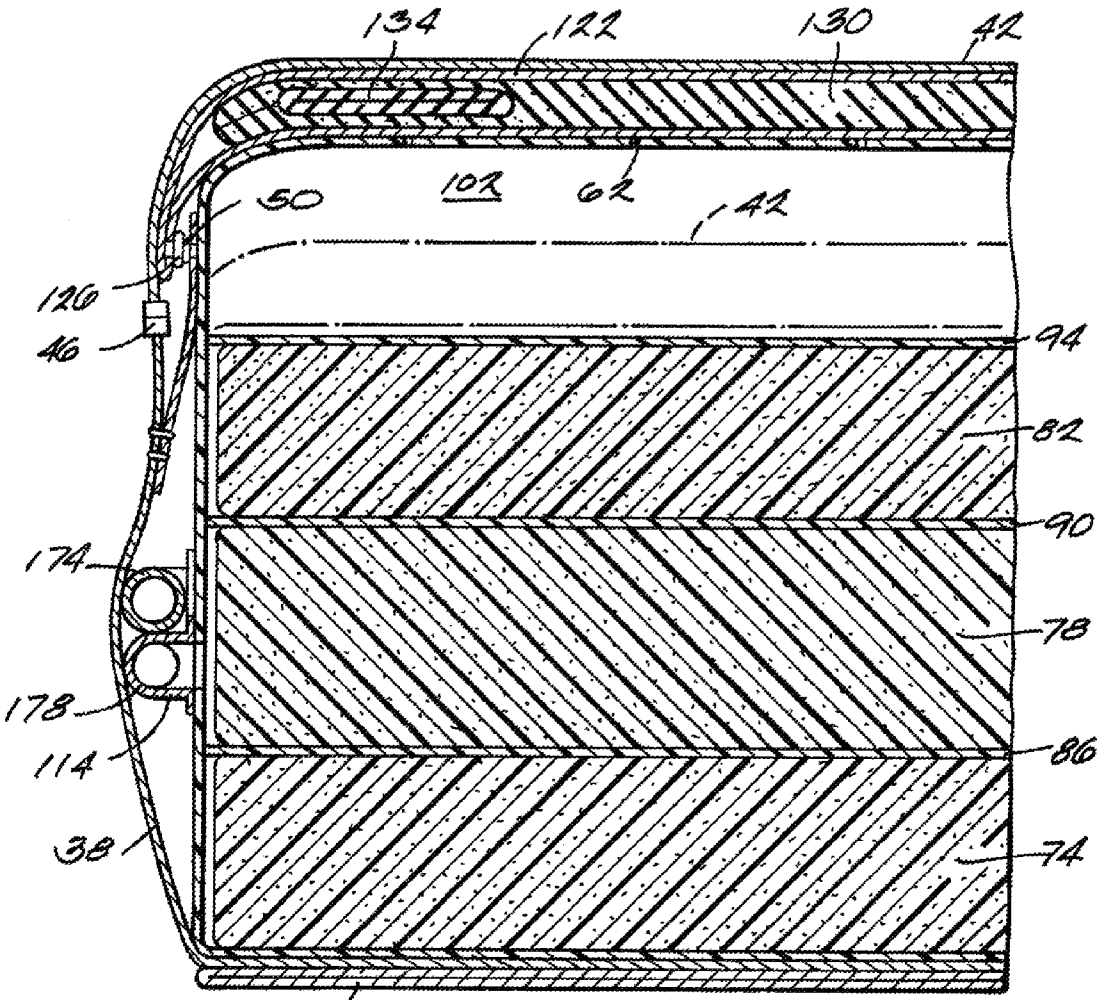
FIG. 6 is a cross-sectional view taken along line 6-6 in FIG. 4, illustrating the cylinder in the inflated and deflated condition (in hidden lines).
Figure 8:
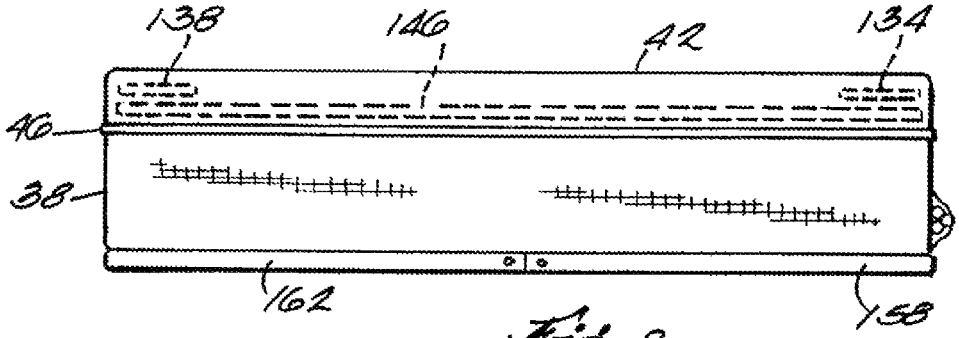
FIG. 8 is an end view illustrating the therapeutic mattress assembly shown in FIG. 1, illustrating a calf lift bladder in the deflated position.
Figure 9:
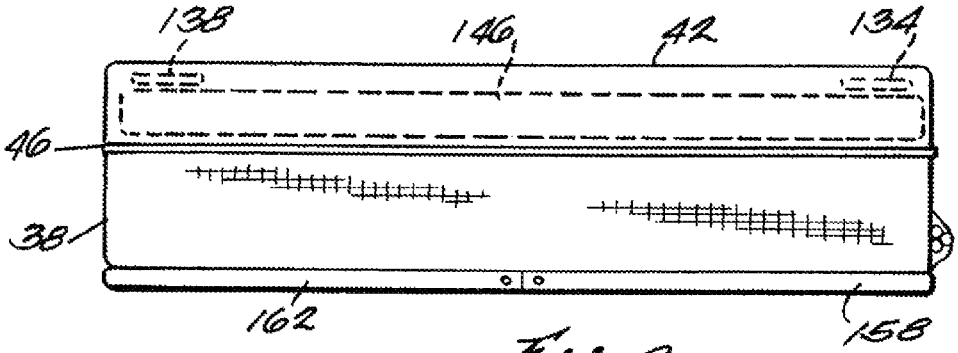
FIG. 9 is an end view of the therapeutic mattress assembly shown in FIG. 1, illustrating the calf lift bladder in the inflated position.

As shown in FIG. 7, the cylinder 58 also includes two tabs 106, each connected to one end of the cylinder 58. The tabs 106 are positioned near the top of the ends of the sleeve 52 and extend generally away from the sleeve 52. The tabs 106 are preferably made from the same material as the sleeve 52. The cylinder 58 also includes snaps 110 located on the outward end of each of the tabs 106. The snaps 110 are detachably connectable to mating snaps 50 located on the interior face of the bottom cover 38 side wall. The mating snaps 50 fixably position the cylinders 58 at equal distances along the length of the bottom cover 38. It should be noted that snaps are only the preferred device used for connection. Other methods of connection may also be used, such as hook and loop fasteners, buttons, zippers, laces, and the like. As best shown in FIG. 6, the cylinders 58 also include, a cylinder coupling 114 located on one end of the cylinder 58 to facilitate the transfer of air from the blower assembly 20 into the air cavity 102 of the sleeve 52 without substantial loss to the atmosphere.

The mattress 14 is configured to provide a low air loss system that allows air to reach surfaces of the patient's body that contact the mattress 14 from the inflated cylinders 58. The blower 22 provides a constant air flow to the cylinders 58 while the upper surface of the cylinders 58 are perforated to permit the air to escape. The cylinders 58 can maintain a constant desired air pressure even though air is slowly leaking through the upper surface of the cylinders 58 because air is constantly circulated to the cylinders 58.

Referring to FIGS. 2 and 4-7, the mattress 14 also includes an overlay assembly 118 positioned above the substrate assembly 54 and between the top and bottom covers 42, 38. The overlay assembly 118 includes an overlay cover 122 having a top surface and a bottom surface connected along their respective perimeters defining an internal cavity. Preferably, the overlay cover 122 is made from two types of material. The perimeter portion of the overlay cover 122 is preferably made from a non-resilient nylon fabric and the central portion of the overlay cover 122 is preferably made from an air permeable, four way stretch fabric that allows for the expansion of the cylinders 58 and the passage of air from the cylinders 58 to the patient. The overlay cover 122 includes a plurality of cover snaps 126 positioned uniformly around the perimeter of the overlay cover 122 and attached to the perimeter portion. The cover snaps 126 are detachably connectable to mating snaps 50 located on the exterior face of the bottom cover 38 side wall. The cover snaps 126 secure the overlay assembly 118 to the bottom cover 38 and fixably position the overlay assembly 118 over the cylinders 58.

The overlay assembly 118 also includes a foam cushion 130 positioned within the cavity of the overlay cover 122. The foam cushion 130 is preferably approximately 1 inch thick and is made of visco-elastic foam material. The foam cushion 130 includes a plurality of holes substantially aligned on center with the pin-sized holes 66 of the cylinders 58 to facilitate the flow of air through the foam cushion 130 to the patient. Preferably, a die cutting process is used to remove plugs of material from the foam cushion 130 to form an array of properly aligned ¼ inch diameter holes. The array of holes preferably only extends to about 4 inches from the perimeter of the foam cushion. The size and number of holes cut into the foam cushion 130 are limited to assure a sufficient percentage of foam remains to provide adequate support to the patient.

The overlay assembly 118 also includes a first bolster 134 and second bolster 138, positioned within the foam cushion 130 along opposite ends of the foam cushion 130. The first and second bolsters 134, 138 are inflatable bladders that extend approximately the entire length of the foam cushion 130. Each bolster 134, 138 includes a bolster coupling 142 that allows air to be transferred from the blower assembly 20 to inflate the bolsters 134, 138. Preferably, the bolsters 134, 138 are approximately 4 inches wide and have a negligible thickness in the deflated condition. The bolsters 134, 138 are located approximately 1 inch from the edge of the foam cushion. Preferably, the bolsters 134, 138 are inserted into the foam cushion 130 by splitting the edge of the foam cushion 130 into two flaps of equal thickness. After placing the deflated bolsters 134, 138 within the approximately 5 inch deep cut, the two equally thick flaps are refastened together along the common edge by a glue or similar adhesive. Once inflated, the bolsters 134, 138 cross-sections will expand to a generally circular shape.

As shown in FIGS. 2-4 and 8-9, the mattress 14 also includes a calf lift bladder 146 positioned between the cylinders 58 and the overlay assembly 118. The calf lift bladder 146 includes a single inflatable chamber 150 located near the foot end of the mattress 14 and extending across the width of the mattress 14. The calf lift bladder 146 includes a calf lift coupling 154 that facilitates the air flow from the blower assembly 20 into the inflatable chamber 150. The position of the calf lift bladder 146 can be adjusted along the length of the therapeutic mattress 14 according to the height of the patient. The thickness of the calf lift bladder 146 is negligible when the calf lift bladder 146 is deflated. When inflated, the calf lift bladder 146 creates a bulge in the therapeutic mattress 14, raising the patient's calves relieving the pressure on the patient's heels and/or ankles. The calf lift bladder 146 can be set to any position between the filly inflated and fully deflated positions to properly accommodate the patient.

Figure 10:
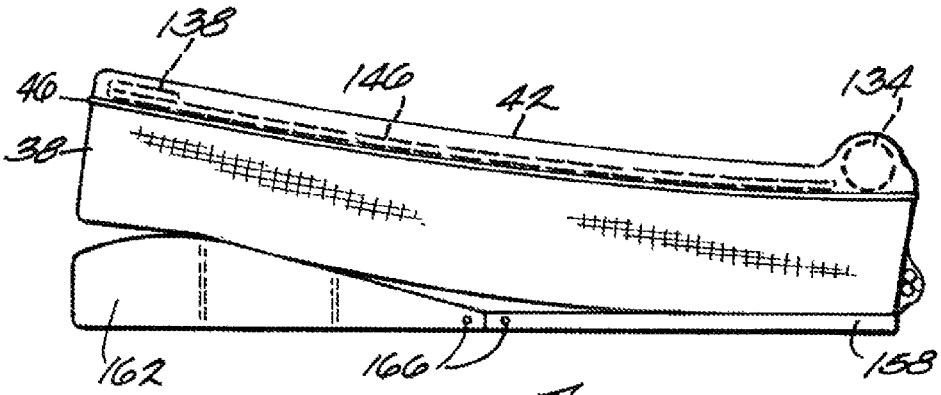
FIG. 10 is an end view of the therapeutic mattress assembly of FIG. 1, illustrating a first lateral rotation wedge in the inflated position.
Figure 11:
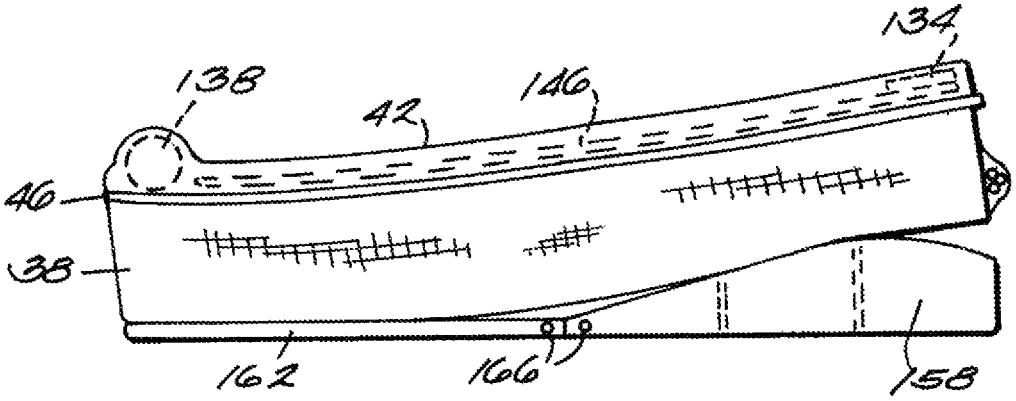
FIG. 11 is an end view of the therapeutic mattress assembly of FIG. 1, illustrating the second lateral rotation wedge in the inflated position.

As shown in FIGS. 2, 10, and 11, the lateral rotation assembly 18 includes first and second lateral rotation wedges 158, 162 extending the length of the mattress 14 and located under the mattress 14. The lateral rotation wedges 158, 162 each include a wedge coupling 166 that allows air to flow into the lateral rotation wedges 158, 162 from the blower assembly 20. Each lateral rotation wedge 158, 162 can be inflated to a wedge shape with the narrowest portion of the wedge in the center of the mattress 14 and the widest portion of the wedge near the outer edge of the mattress 14. The upper surface of the wedge 158, 162 is preferably a convex surface with the maximum height positioned toward the outer edge. More preferably, the first one third of the convex surface has a decreasing positive slope ending at the maximum height. The following two thirds of the lateral inflation wedge 158, 162 has an increasing negative slope terminating at the center of the mattress 14. These lateral rotation wedges 158, 162 can be individually inflated to raise each respective side of the mattress 14 to effectively turn a patient on their side to alternate the part of the body which supports the weight. Some patients may also require lateral rotation to drain a buildup of fluid in the lungs. Each lateral rotation wedge 158, 162 can tilt its respective half of the mattress 14 to an angle of approximately 30 degrees from the center of the mattress 14. The bolsters 134, 138 of the overlay assembly 118 also inflate with the lateral rotation wedges 158, 162 to secure the patient on the mattress 14 while one side is being raised. Preferably, only the bolster positioned opposite the inflated lateral rotation bladder is inflated.

Referring to FIG. 1, the blower 22 is the air source for and is in fluid flow connection with air cylinders 58, the lateral rotation wedges 158, 162, the bolsters 134, 138, and the calf lift bladder 146. The valve assembly 26 includes valve 170 that is in fluid flow connection with the blower 22 and which selectively distributes the air flow from the blower 22 to the air cylinders 58, the lateral rotation wedges 158, 162 and the bolsters 134, 138, and the-calf lift bladder 146. The valve assembly 26 includes first and second cylinder hoses 174, 178, first and second lateral rotation hoses 190, 194, and first and second bolster hoses 182, 186 that are fluidly connected to the first and second lateral rotation hoses 190, 194, respectively.

The first cylinder hose 174 is in fluid flow connection between the valve 170 and approximately ½ of the cylinder couplings 114 of the cylinders 58. Specifically, the first cylinder hose 174 supplies air flow to alternating cylinders 58 along the length of the mattress 14. The second cylinder hose 178 is in fluid flow connection between the valve 170 and the cylinder couplings 114 of the remaining cylinders 58 not coupled to the first cylinder hose 174.

The first lateral rotation hose 190 is in fluid flow connection between the valve 170 and the wedge coupling 166, and the second lateral rotation hose 194 is in fluid flow connection between the valve 170 and the wedge coupling 166 of the second lateral rotation wedge 162. The first bolster hose 182 is fluidly connected to the second lateral rotation hose 194, and the second bolster 186 is fluidly connected to the first lateral rotation hose 190. The holster hoses 182, 186 are coupled to the lateral rotation hoses 190, 194 such that only the opposite bolster 134, 138 inflates with a lateral rotation wedge 158, 162.

The valve 170 also independently controls the inflation and deflation of the calf lift bladder. The valve assembly 26 includes a calf lift hose 202 that is in fluid flow connection between the valve 170 and the calf lift coupling 154.

The controller 30 regulates the valve assembly 26, and the blower 22 based upon desired mattress conditions. The controller 30 contains a microprocessor and can be programmed to increase or decrease the air pressure in the cylinders 58, the calf lift bladder 146, the lateral rotation wedges 158, 162, and the bolsters 134, 138.

In operation, the controller 30 manipulates the therapeutic mattress assembly 10 between multiple modes of operation. Specifically, the therapeutic mattress assembly 10 functions in four modes of operation: (1) Power on; (2) Power off; (3) Lateral rotation; and (4) Alternating pressure. The modes of operation will be discussed in further detail below.

In the power on mode, as best shown in FIGS. 5-7, the controller 30 activates the blower 22 to create an air flow to the valve assembly 26 at a desired pressure. The controller 30 also manipulates the valve 170 to allow the air to flow only to the first and second cylinder hoses 174, 178. The air then flows through the cylinder couplings 114 into all of the cylinders 58. The air flow increases the pressure within each cylinder 58 causing each of the cylinders 58 to expand. A constant pressure is maintainable within each of the cylinders 58 because although air is allowed to escape through the pin-sized holes 66 in the cylinder sleeves 52. The air that escapes the cylinders 58 is forced through the air permeable overlay cover 122 and the holes in the foam cushion 130. Finally, the air is forced through the top cover 42 and against the body of the patient to remove moisture and encourage healing.

In the power off mode, as shown in broken lines in FIG. 6, the blower 22 does not provide an increased air pressure and the air within the therapeutic mattress assembly 10 is released. This mode may occur during transport of a mattress assembly 10 where an independent power source is not available, or during a power outage. Because the cylinders 58 are not supplied with an increased air pressure, the cylinders 58 are in the deflated position and the interior surface of the cylinder sleeve 52 is positioned directly against the third horizontal gusset 94 of the cylinder 58. As opposed to other low air flow mattresses in the power off mode, the patient will still receive adequate pressure distributing support from the mattress 14. In this situation the body's weight is supported essentially by the foam cushion 130 of the overlay assembly 118 and the top foam layer 82, the intermediate foam layer 78, and the base foam layers 70, 74 of each of the cylinders 58.

As best shown in FIGS. 10 and 11, the lateral rotation mode operates from the power off mode to allow for proper positioning of the mattress 14. In the lateral rotation mode, the controller 30 activates the blower 22 to create an air flow to the valve assembly 26 at a desired pressure. The controller 30 also manipulates the valve 170 to allow the air to flow only to bolster hoses 182, one of either the first 190 or second lateral rotation hose 194 and the respective bolster hose 182, 186. The air then flows through the wedge coupling 166 into one of the lateral rotation wedges 158, 162 expanding the wedge into the inflated position and through one of the bolster couplings 142 into the respective bolster 134, 138 causing the respective bolster 134, 138 to expand to the inflated position. The inflated lateral rotation wedge raises the respective end of the mattress 14 to rotate the patient on the mattress 14. The inflated bolster 134, 138 secures the patient on the mattress 14 and aids in preventing the patient from rolling off of the mattress 14. If the patient needs to be turned in the other direction, the controller 30 activates the valve 170 direct the air flow to the deflated lateral rotation wedge 158, 162 and bolster 134, 138.

In the alternating pressure mode, the controller 30 activates the blower 22 to create an air flow to the valve assembly 26 at a desired pressure. Referring to FIG. 2, the controller 30 also manipulates the valve 170 to allow the air to flow only to the first cylinder hose 174. The air then flows through the cylinder couplings 114 into only the cylinders 58 connected to the first cylinder hose 174. The air flow increases the pressure within each of these cylinders 58 causing them to expand. A constant pressure is maintained within each of these cylinders 58 in a manner similar to that explained above. To relieve the pressure applied to the body by the inflated cylinders 58 over a period of time, the controller 30 manipulates the valve 170 to release the air from the inflated cylinders 58 and allow the air to flow into the second cylinder hose 178. The air will then flow through the cylinder couplings 114 into only the cylinders 58 connected to the second cylinder hose 178, specifically, the previously deflated cylinders 58. The controller 30 can be programmed to set a period of time between alternating conditions, or otherwise the rotation can be done at any time desired by the operator.

In any of the above mentioned modes, the controller 30 can independently adjust the valve 170 to inflate or deflate the calf lift bladder 146. As shown in FIGS. 1, 3, 8, and 9, the adjustment of the pressure communicated to the calf lift bladder 146 directly adjusts the distance that ankles and/or heels are lifted above the bed. Specifically, the controller 30 activates the blower 22 to create an air flow to the valve 170 at a desired pressure. The controller 30 also manipulates the valve 170 to allow the air to flow through the calf lift hose 202 to the calf lift coupling 154. The air then flows through the calf lift coupling 154 into the calf lift bladder 146. The air flow increases the pressure within the calf lift bladder 146 causing it to expand and raise a patient's feet. Alternatively, if the operator wishes to lower the patient's feet, the controller 30 adjusts the valve 170 to release air from the calf lift bladder 146. The released air lowers the pressure within the calf lift bladder 146 causing the patient's feet to lower.

What is claimed:

1. A method of manufacturing a mattress assembly for supporting a body, the method comprising:

providing a foam layer;

separating first side edge of the foam layer into a first flap and a second flap;

placing a first inflatable bladder between the first and second flaps; and reconnecting the first flap to the second flap.

2. The method of claim 1, wherein reconnecting the first and second flaps includes refastening the first and second flaps together with an adhesive.

3. The method of claim 1, wherein the foam layer includes a viscoelastic foam.

4. The method of claim 1, further comprising forming an array of holes in the foam layer to facilitate an airflow to the body.

5. The method of claim 4, wherein forming the array of holes includes dies cutting the foam layer.

6. The method of claim 4, further comprising supporting the foam layer with a substrate assembly including low air loss cylinders for providing the airflow.

7. The method of claim further comprising;

separating a second side edge of the foam layer into a first flap and a second flap;

placing a second inflatable bladder between the first and second flaps of the second side edge; and reconnecting the first flap of the second side edge to the second flap of the second side edge.

8. The method of claim 7, further comprising coupling a blower assembly to the first and second inflatable bladders for controllably supplying it to the first and second inflatable bladders.

9. The method of claim 1, wherein reconnecting the first flap to the second flap includes completely encasing the first inflatable bladder with the foam layer.

10. The method of claim 1, wherein placing the first inflatable bladder between the first and second flaps includes locating the first inflatable bladder in a top layer of the mattress assembly.

* * * * *